US010173810B2

(12) United States Patent
Chang

(10) Patent No.: US 10,173,810 B2
(45) Date of Patent: Jan. 8, 2019

(54) CAPS AND ADAPTERS FOR CONTAINERS

(71) Applicant: Unicep Packaging, LLC, SandPoint, ID (US)

(72) Inventor: Lorrin Edward Chang, SandPoint, ID (US)

(73) Assignee: Unicep Packaging, LLC, Sandpoint, ID (US)

( * ) Notice: Subject to any disclaimer, the term of this patent is extended or adjusted under 35 U.S.C. 154(b) by 0 days.

(21) Appl. No.: 15/395,090

(22) Filed: Dec. 30, 2016

(65) Prior Publication Data

US 2018/0186519 A1 Jul. 5, 2018

(51) Int. Cl.
*B65D 41/04* (2006.01)
*B65D 47/06* (2006.01)

(52) U.S. Cl.
CPC ..... *B65D 41/0414* (2013.01); *B65D 47/06* (2013.01)

(58) Field of Classification Search
CPC ..... B65D 75/5872; B65D 83/0055; B65D 41/0414; B65D 51/22
USPC .... 222/81, 541.1, 541.2, 546, 552, 562, 563
See application file for complete search history.

(56) References Cited

U.S. PATENT DOCUMENTS 1,545,103 A * 7/1925 Huntoon, Jr. ..... B65D 47/242 222/520
1,909,209 A * 5/1933 Miller ..... B65D 51/225 222/546
1,925,466 A * 9/1933 Simpson ..... B65D 47/106 222/545
2,051,513 A * 8/1936 Bingham ..... B65D 47/242 222/520
2,127,268 A * 8/1938 Palmer ..... B65D 41/0414 222/546
4,681,243 A * 7/1987 Takasugi ..... B65D 47/121 222/541.2
4,726,484 A * 2/1988 Lutz ..... B65D 41/0414 215/329

* cited by examiner

*Primary Examiner* — Vishal Pancholi
(74) *Attorney, Agent, or Firm* — Lee & Hayes, PLLC

(57) ABSTRACT

A cap may include a top and a sidewall depending from the top. A plug may also extend from the top, spaced from the sidewall. Threads are formed either on an internal surface of the sidewall, i.e., generally facing the plug, or on an external surface of the plug, i.e., generally facing the sidewall. The spacing between the sidewall and the plug generally defines a receptacle configured for receiving an open end of a container. The sidewall and the plug may be angled relative to each other, such that the receptacle has a cross-section that is generally V-shaped.

20 Claims, 5 Drawing Sheets

CAPS AND ADAPTERS FOR CONTAINERS

BACKGROUND

Many compositions, e.g., liquids, gels, and the like, are provided in containers that are not readily re-sealed. For instance, medicines, ointments, salves, and adhesives are commonly provided in polymeric containers. To reduce costs, the containers are often blow-molded or injection molded containers with minimal extra features. For example, conventional containers may include plastic pipettes that have a frangible cap integrated with a body. Removal of the frangible cap, e.g., by severing the cap at a break or score line, exposes an open neck through which the compositions can be expelled from the container. When the frangible cap is removed, there is no mechanism by which the container can be resealed, and the contents must be either used completely or discarded. However, the container often includes sufficient composition for multiple uses, with the result being excess waste.

Moreover, in the types of containers just described, there is no mechanism by which the container can be attached to or otherwise interact with other systems or components, e.g., for facilitating removal of the contents from the container. Removal of the compositions is often facilitated merely by pouring the contents from the container.

SUMMARY

It may desirable to provide a mechanism for re-sealing conventional containers of the type described above. Moreover, it may be desirable to provide an adapter for use with commercially available containers of the type described, e.g., to facilitate use of these relatively low-cost, easy to manufacture containers in additional applications.

This application describes devices that may be configured for attachment to a container, proximate an opening of the container. For instance, a device according to this disclosure may be a cap that include threads on an internal surface for securing the cap to a thread-less neck of the container. The cap may also include a plug or similar protrusion, configured to be positioned in the opening of the container when the cap or adapter is applied. Moreover, the neck of the container may be deformed or otherwise pinched between the threads and the plug. In some implementations, a passageway may also be formed through the cap, providing fluid communication between the inside of the container and the environment. Features may also be provided, in conjunction with the passageway, to promote easier dispensing of the product from the container and/or to allow for integration of the container with existing systems and/or devices.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Figure 1:
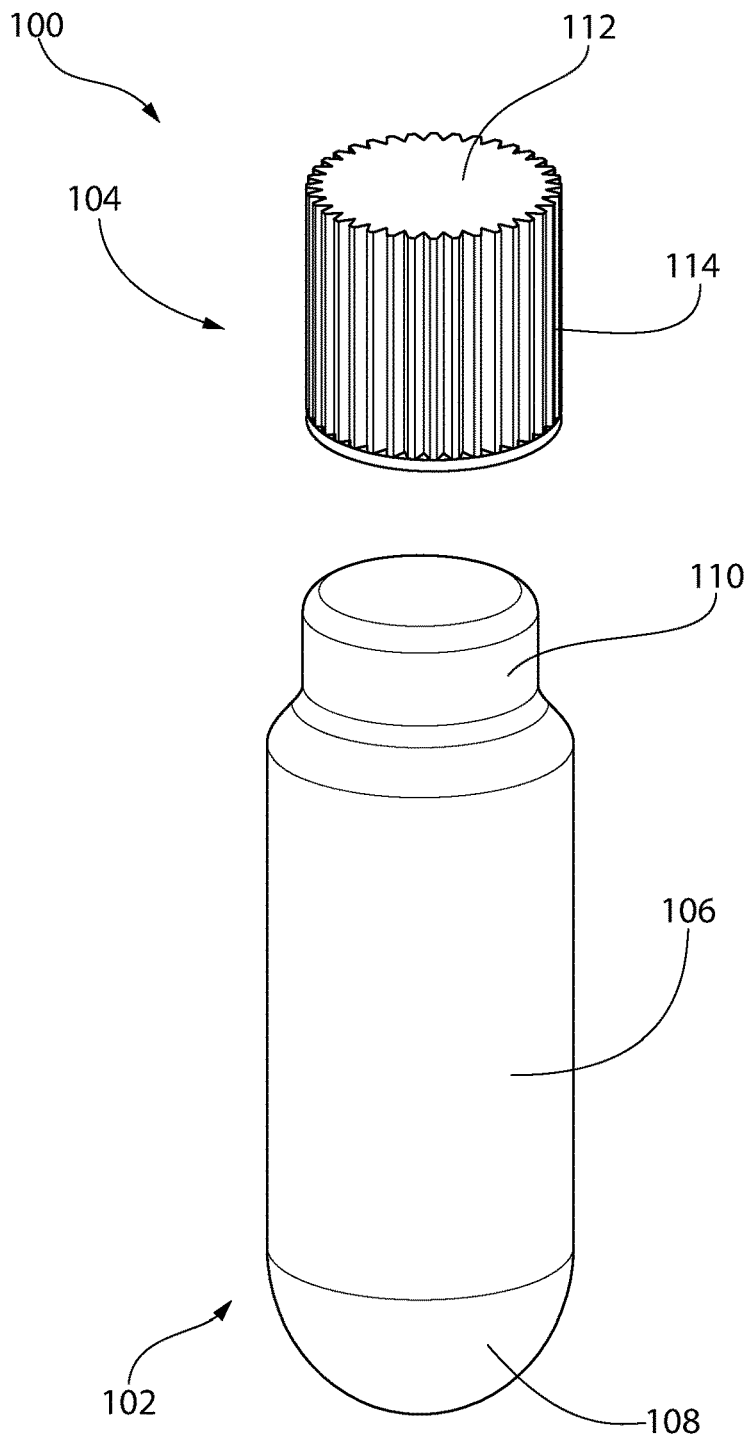
FIG. 1 is an exploded perspective view of a combination container and cap according to embodiments of this disclosure.

This disclosure describes improved caps and adapters, and methods of making and using the caps and adapters. In some implementations of this disclosure, a cap may include a top and a sidewall depending from the top. A plug may also extend from the top, spaced from the sidewall. Threads are formed either on an internal surface of the sidewall, i.e., generally facing the plug, or on an external surface of the plug, i.e., generally facing the sidewall. The spacing between the sidewall and the plug generally defines a receptacle configured for receiving an open end of a container. The sidewall and the plug may be angled relative to each other, such that the receptacle has a cross-section that is generally V-shaped.

In additional implementations of this disclosure, an adapter may also include a top and a sidewall depending from the top. A plug may also extend from the top, spaced from the sidewall. Threads may be formed on an internal surface of the sidewall, i.e., generally facing the plug, or an external surface of the plug, i.e., generally facing the sidewall. The spacing between the sidewall and the plug generally defines a receptacle configured for receiving an open end of a container. The sidewall and an outer surface of the plug may be angled relative to each other, such that the receptacle has a cross-section that is generally V-shaped. The adapter may also include a dispensing feature integrated or otherwise formed on the top. For instance, the dispensing feature may be a nozzle, nipple, luer fitting, threaded attachment, or the like. In adapters according to this disclosure, a passageway may also be provided that extends through the dispensing feature, the top, and the plug. In this manner, when the adapter is threaded onto a container, the passageway provides fluid communication between the interior of the container and an environment external to the dispensing feature. By way of non-limiting example, the dispensing feature may allow for improved control of dispensing contents from the container and/or for attachment of external components, e.g., syringes, conduits, or the like.

In embodiments of this disclosure, the caps and adapters may be specifically designed for application to a container that does not include mating threads, and, in fact, that may not be intended to be resealed. For instance, the container may include a neck defining an opening, with the opening being originally covered by a frangible covering. Before removal, the covering seals the opening, such that substance in the container does not inadvertently leak or otherwise leave the container. However, upon removal, the covering may be discarded, inasmuch as it is not intended for resealing of the container. In some examples, the cover may be retained on a base of the container via a frangible connection. In this example, the cover may be removed by application of a shear force sufficient to break the frangible connection. Containers of the type just described may be cheaper to produce than conventional containers that include threads or other sealing and/or attachment features, but are conventionally not used because of their structural limitations.

For discussion purposes, some example embodiments of containers, caps and adapters are described herein. However, the specific implementations herein are not limited to the particular examples provided, and may be extended to other types of containers, adapters, and the like, as will be apparent to those of skill in the art in light of the disclosure. By way of non-limiting example, although a certain type of container is illustrated in the FIGS., caps and adapters described herein may be useful with other containers, including but not limited to vials, pipettes, tubes, and other types of packaging. The specific features and acts are disclosed as example forms of implementing the claims.

FIG. 1 illustrates an apparatus 100 according to embodiments of this disclosure. More specifically, the apparatus 100 generally includes a container 102 and an attachable cap 104.

The container 102 according to the illustrated embodiment is generally cylindrical and includes a sidewall 106 extending between a closed base 108 and a neck 110. The sidewall 106, base 108, and the neck 110 generally define a volume or reservoir. In the illustrated embodiment, the neck 110 defines an opening that allows fluid communication between the reservoir and an exterior of the container 102. As noted above, the container 102 may be of a conventional type that comes sealed, e.g., by a frangible or severable cap, tip, or covering. Such a cap/tip/covering that may be initially provided is not illustrated in FIG. 1 (although FIG. 2A does illustrate one example of a cap). Instead, the cap or tip has been removed, thereby allowing for emptying of contents contained in the reservoir through the opening defined by the neck. An example container will be described below, in more detail, with reference to FIGS. 2A and 2B.

The cap 104 generally includes a top 112 and a sidewall 114 depending from the top 112. In FIG. 1, the sidewall 114 includes a plurality of ridges formed on an outer surface thereof. The ridges may be provided to enhance a user's ability to grip and turn the cap and/or for aesthetic purposes, for example. Other patterns, features, substances, designs, or the like may be provided on the outer surface of the sidewall, instead of the ridges, or in some embodiments the sidewall may be smooth, i.e., with no features.

Although not illustrated in FIG. 1, threads are formed on an inner surface of the sidewall 114. The threads are disposed to engage an outer surface of the neck 110, even though the outer surface of the neck 110 may not be threaded. The cap 104 also includes a protrusion or plug extending from the top 112, circumscribed by the sidewall 114. Detailed examples of the cap 104 are illustrated in and discussed with respect to FIGS. 3A, 3B, 4, 5, and 6, below.

Figure 2B:
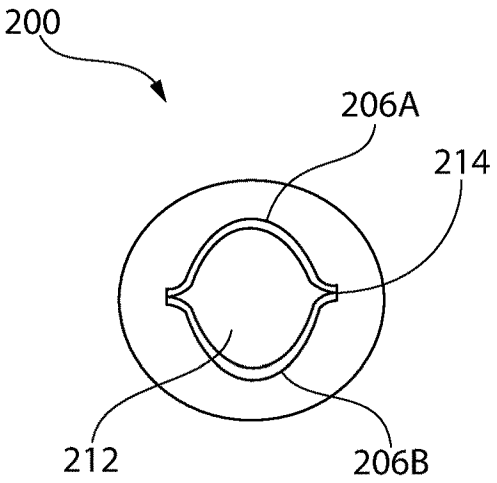
FIGS. 2A and 2B are plan side and top views, respectively, of a container, such as the container illustrated in FIG. 1, according to embodiments of this disclosure.
Figure 2A:
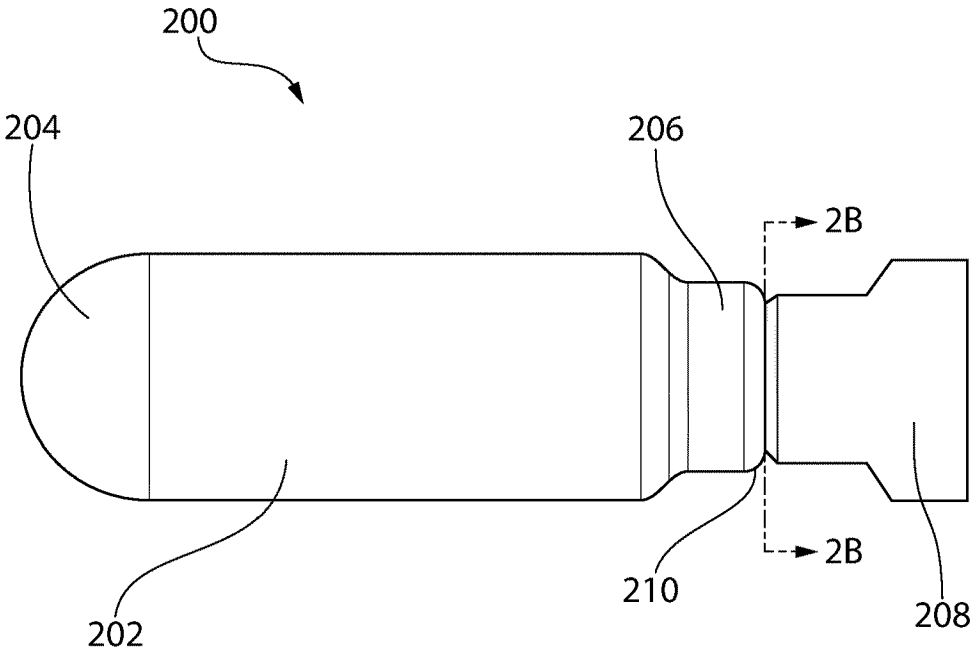

FIGS. 2A and 2B illustrate an example of a container 200 for which the caps and adapters according to this disclosure may be particularly useful. The container 200 may be the container 102 discussed above. In FIG. 2A, the container 200 includes a generally cylindrical sidewall 202 extending between a closed base 204 and a neck 206. As also illustrated, the container 200 includes a removable covering 208 fixed to the neck 206 at a frangible portion 210. In operation, the covering 208 is separated from the neck 206 at the frangible portion, e.g., by twisting the covering 208 relative to the neck 206, by cutting along the frangible portion 210, or the like. In the illustrated embodiment, the covering 208 is not configured for reattachment to the remainder of the container 200 once removed. For example, the covering may be intended to be discarded.

As illustrated in FIG. 2B, removal of the covering 208 exposes an opening 212 defined by the neck 206. The opening 212 generally provides a fluid communication between an interior volume of the container 200 and the exterior. More specifically, contents within the container 200 are removed from the container 200 via the opening 212.

Although the illustrated container 200 is generally cylindrical, other shapes may be used. For example, the sidewall 202 may include one or more planar surfaces and/or may be tapered between the base 204 and the neck 206. Moreover, while the closed base 204 is illustrated as being generally domed, in alternative embodiments, the closed base 204 may be generally planar or include a planar surface. For instance, the closed base 204 may include a planar surface generally perpendicular to a longitudinal axis of the container 200. In this manner, the container 200 may be configured to stand on the base 204, i.e., on a horizontal surface. Other modifications will also be appreciated. Functionally, it may generally only be required that the container 200 define a reservoir that can hold a substance and include an opening.

The container 200 may be deformable such that a user can readily decrease the volume of the reservoir, i.e., to force contents of the container 200 toward and, in some instances, through the opening 212. For instance, the sidewall 202 and/or the base 206 may be flexible such that a user can displace them toward a middle of the reservoir, e.g., by squeezing. In other embodiments, the container 200 may be relatively rigid, with contents contained in the reservoir being expelled through the opening 212 when the container 200 is tipped or tilted sufficiently to allow gravity to move the contents to and potentially through the opening 212.

As detailed in FIG. 2B, the neck 206 may be formed from a thin-walled material, such as a polymer, and thus includes an outer surface 206*a* and an inner surface 206*b*. Depending upon the manufacturing process used to form the container 200, the neck 206 may be other than perfectly cylindrical. For example, the container 200 may be formed using a blow-fill-seal process, and as a result of that process, the neck 206 may include one or more seams 214, as illustrated. The irregularities caused by the seams, or other irregularities caused by other manufacturing processes or tolerance variations may be generally acceptable in these types of containers, inasmuch as they are often intended for a single use. Specifically, the cap 208 is not intended to, and in fact cannot, re-seal the opening 212. Accordingly, the shape of the neck is generally of lesser concern. Nevertheless, as noted above, there are instances in which it may be desirable to re-seal the container 200 or to use the container 200 in an existing system. The irregularity of the outside surface of the neck (compared to a substantially smooth cylinder, for example), does not lend itself well to conventional caps and actuators.

As noted above, in some implementations, the container 200 may be manufactured via a blow-fill-seal process. Other manufacturing techniques are also contemplated, for example, a blow-molding process, an injection molding process or any other manufacturing process suitable for forming the container. Depending on the product to be contained in the container for application and the manufacturing process, the container may comprise a polymer, such as polyethylene, ethyl vinyl alcohol copolymer or any other suitable polymer, mixture or the like that is suitable for forming the container. For example, low-density polyethylene (LDPE), high-density polyethylene (HDPE) or, polypropylene (PP) may be used to form the container.

Figure 3B:
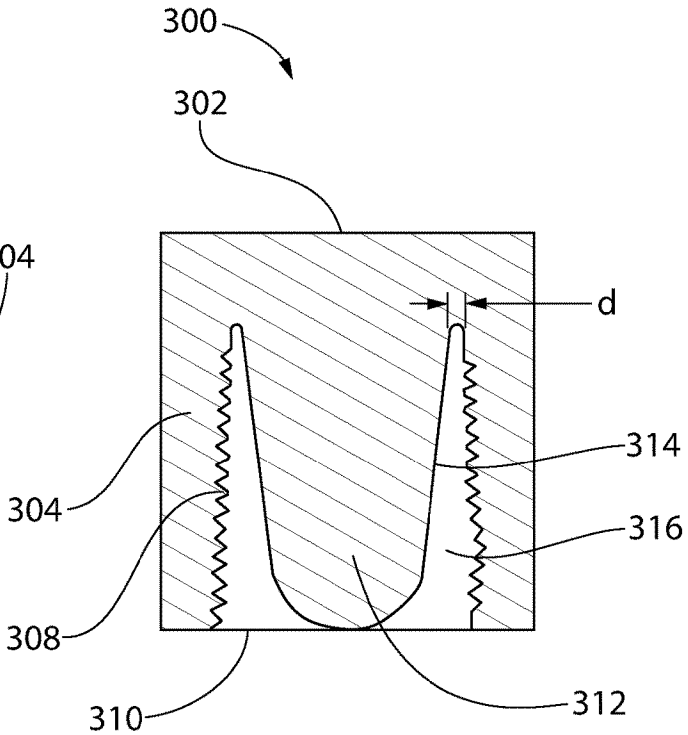
FIG. 3B is a cross-sectional view of the cap of FIG. 3A, taken along section line A-A in FIG. 3A.
Figure 3A:
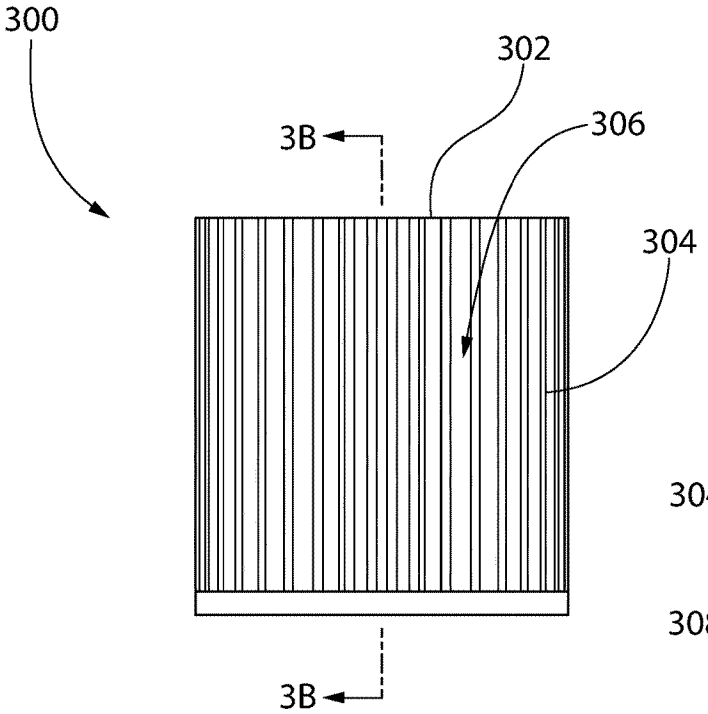
FIG. 3A is a side plan view of a cap, such as the cap illustrated in FIG. 1, according to embodiments of this disclosure.

FIGS. 3A and 3B illustrate an example of a cap 300, such as the cap 104, used to seal containers, such as the container 200. The cap 300 generally includes a top 302 and a sidewall 304 depending from the top 302. As illustrated, the sidewall 304 is generally cylindrical, and is formed about a longitudinal axis of the cap 300. Although the sidewall 304 is generally illustrated as a cylindrical, other shapes may be used instead. Is also illustrated in FIG. 3 A, a plurality of ridges 306 extend generally in the longitudinal axis on an exterior of the sidewall 304. As discussed above in connection with the cap 104, the ridges 306 may be provided as a tactile feature that promotes gripping and twisting of the cap 300. Alternatively or in addition, the ridges 306 may provide an aesthetic element to the cap 300. The ridges 306 may be replaced by other features or designs, and in some embodiments, the ridges 306 may be omitted entirely. For instance, the exterior of the sidewall 304 may be completely smooth.

As best illustrated in the cross-section of FIG. 3B, the sidewall 304 has a thickness between an external surface and an internal surface. A plurality of threads 308 are formed on the internal surface of the sidewall 304. In one example embodiment, the threads may be a standard thread, such as an ANSI/ASME thread, a pipe thread or a J thread although the threads may be of other types without departing from the spirit and scope of this disclosure. As also illustrated in FIG. 3B, the threads 308 may be tapered relative to the longitudinal axis. For instance, the threads 308 proximate a bottom 310 of the cap 300 may be further from the longitudinal axis than threads closer to the top 302. In this arrangement, when the outer surface of the sidewall 304 is cylindrical, the sidewall 304 is generally thinner proximate the bottom 310 than it is proximate the top 302.

As also illustrated in FIG. 3B, the cap 300 includes a plug or protrusion 312 extending generally along the longitudinal axis from underside of the top 302. As illustrated, the plug 312 is spaced from the threads 308 such that an external surface 314 of the plug 312 and the threads 308 define a substantially cylindrical opening or receptacle 316. As illustrated, the external surface 314 of the plug 312 is tapered relative to the longitudinal axis of the cap 300 such that the plug 312 has a relatively larger diameter proximate the top 312 of the cap 300 and a relatively smaller diameter proximate the bottom 310 of the cap 300.

In the embodiment of FIG. 3B, the taper of the threads 308 combined with the taper of the external surface 314 of the plug 312 results in the receptacle 316 having a generally V-shaped cross-section. More specifically, the receptacle 316 is relatively narrow or proximate the top 302 of the cap 300 and relatively wider proximate the bottom 310 of the cap 300. As will be appreciated by those having ordinary skill in the art, the V-shaped cross-section of the receptacle 316 is achieved in the illustrated embodiment by tapering both the threads 308 and the external surface 314 of the plug 312. In other embodiments, this cross-section may be achieved by tapering only one of the threads 308 and the external surface-314 of the plug 312. Put simply, the V-shaped cross-section will result from any configuration in which the threads are angled relative to the outer surface 314 of the plug 312.

In FIG. 3B, the distance between the external surface 314 of the plug 312 and the surface of the sidewall 304 upon which the threads 308 are formed is designated by the letter d. Closest the top 302, the distance d is less than a thickness of a neck of the container to which the top is to be applied. As will be appreciated, because of the relative taper of the receptacle 316, the cap 300 may be used with containers having varied and/or irregular neck diameters and thicknesses.

In use, the cap 300 is placed over the neck of a container, such as the container 200 discussed above, such that the plug 312 extends into the opening defined by the neck and the neck is disposed in the receptacle 316. Although the neck does not include threads that mate with the threads 308, turning of the cap 300 will nevertheless thread the cap 300 onto the container, e.g., by forming an interference fit between the threads 308 and the external surface of the neck. In some embodiments, the threads will be formed of a material that has a hardness greater than a hardness of the neck of the container, and the relative twisting of the cap on the container will cause the neck to deform. For instance, the threads may "dig" into the outer surface of the neck and/or the neck may deform to fill the receptacle 316. With the illustrated cap 300, the plug 312 may contact an inner surface of the neck and therefore provide a rigid surface to effectively trap the neck between the threads 308 and the plug 312. For example, the plug 312 may prevent the neck of the container from collapsing, and may define a space into which the neck of the container may deform. Moreover, because the distance d is varied along the longitudinal axis, irregularities and variances in the neck, such as the seams discussed above with reference to FIGS. 2A and 2B, generally do not affect the retainability of the cap 300 on the container. Moreover, when the cap is formed of a relatively harder material than the container, the neck will deform to take the shape of the receptacle, which may help prevent leaking between the neck and the threads. As will be appreciated, the cap 300 may allow for resealing of a container, such as the container 200, which is otherwise not intended for resealing.

In some implementations, the cap 300 may be manufactured using an injection molding process. Other manufacturing techniques are also contemplated, for example, a machining process or any other manufacturing process suitable for forming the cap 300. The cap 300 may be relatively rigid and is generally non-porous. For example, the cap 300 may comprise a polymer, such as polypropylene. Other materials, including LDPE, HDPE, and non-polymeric materials may also be used to form the cap 300. It is generally desirable that, when the threads are formed as an integral part of the cap 300, e.g., when the entirety of the cap 300 is of a uniform composition, that the material chosen is sufficiently rigid that the threads are able to function with material of the container. For example, it may be desirable that the threads are formed from a material having a hardness greater than a hardness of the container, or at least of the neck of the container, to which the cap is to be threaded. In other embodiments, the cap may be formed of multiple different materials. For example, the threads may be provided separately, e.g., as a metal portion, with the remainder of the cap being overmolded, i.e., over the threads.

Variations to the cap 300, in addition to those already discussed, also are contemplated. For example, the profile of the receptacle 316 may be varied. Moreover, although the plug 312 is illustrated as extending generally to the bottom 310 of the cap 300, variations to the plug 312 also are contemplated. For example, the plug 312 may be shorter, that is, it may not extend all the way to the bottom 310, or the plug 312 may be longer, i.e., protrude below the bottom 310 of the cap 300. The profile and shape of the plug 312 may also be varied. For example, instead of having a domed distal end, the end may be flat. In still other embodiments, the distal end of the plug 312 may be pointed. In this example, the plug 312 may be useful to pierce a foil or other protective covering on the live In some embodiments, the plug 312 may not be included, although as noted above, the plug 312 may help promote application of the cap 300 onto the container 200, e.g., by preventing the neck of the container from collapsing.

Figure 5:
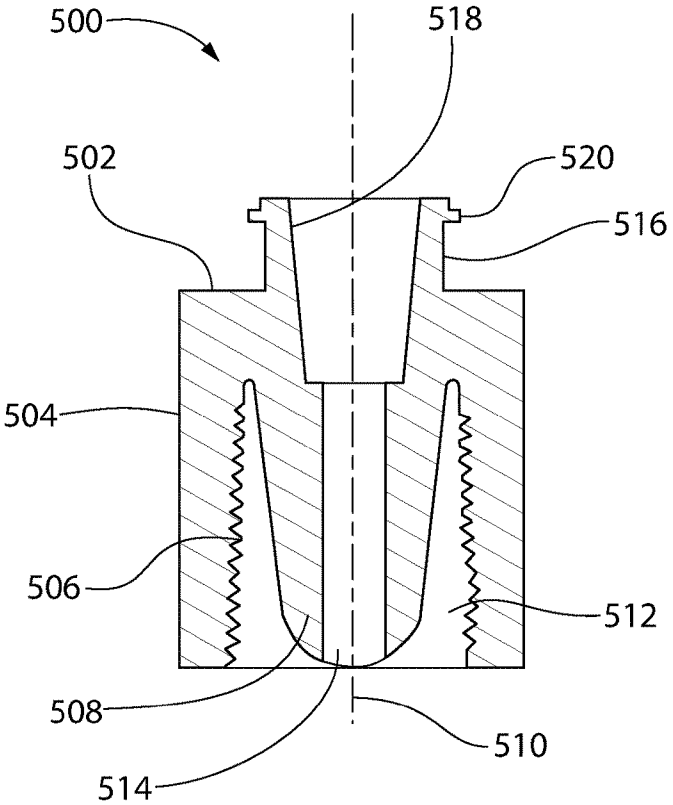
FIG. 5 is a cross-sectional view of an adapter for a container, according to alternative embodiments of this disclosure.
Figure 4:
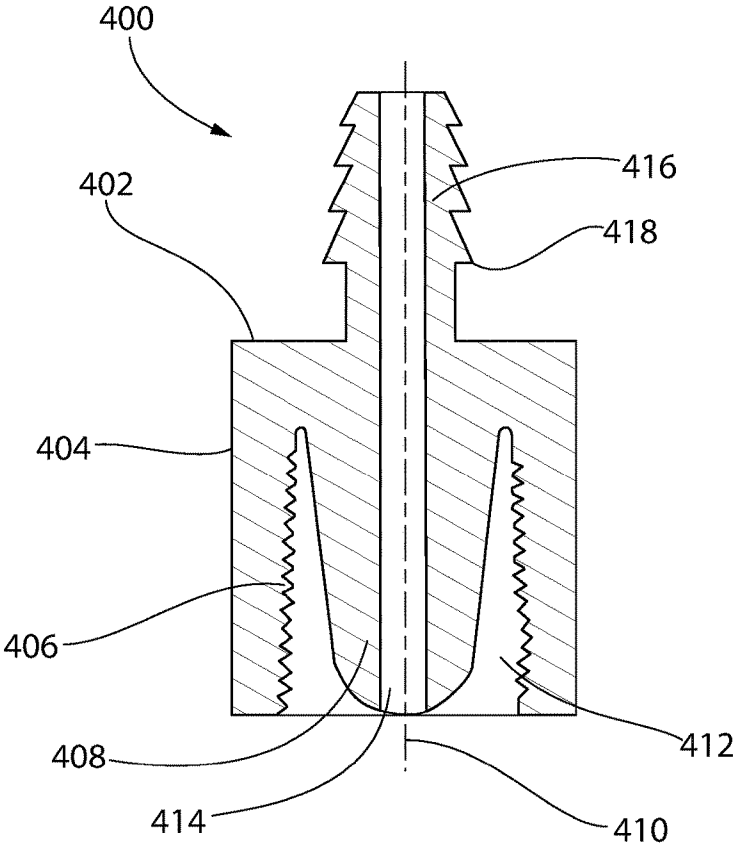
FIG. 4 is a cross-sectional view of an adapter for a container, according to alternative embodiments of this disclosure.
Figure 6:
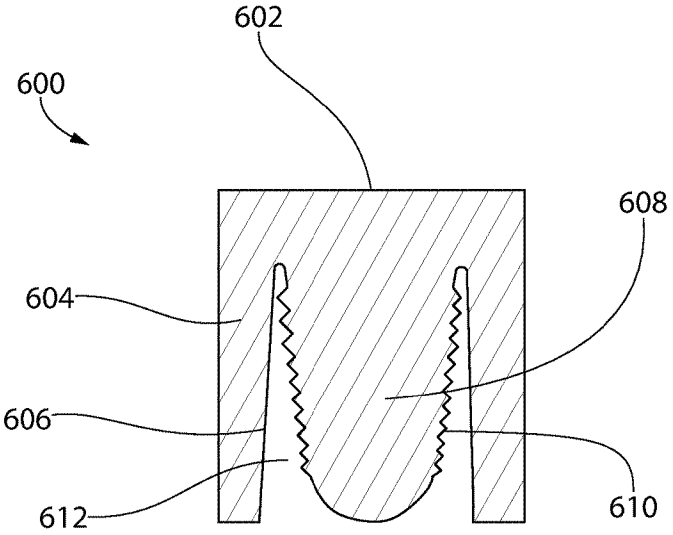
FIG. 6 is a cross-sectional view of a cap for a container, according to alternative embodiments of this disclosure.

FIGS. 4-6 also illustrate modifications to the cap 300 just discussed. More specifically, FIGS. 4 and 5 illustrate alternative caps that include dispensing features such that the caps function as adapters and FIG. 6 illustrates a cap 600.

FIG. 400 illustrates an adapter 400 that includes features similar to the cap 300 discussed above. For example, the adapter 400 generally includes a top 402 and a sidewall 404 depending from the top 402. Threads 406 are formed on an inner surface of the sidewall 404. A plug 408 also is provided, and extends generally along a longitudinal axis 410 of the adapter 400. An outer surface of the plug 408 and the threads 406 define a receptacle 412 configured to receive a neck of the container, such as the container 200 discussed above. Inasmuch as these features and their respective functionalities were described in detail above with regard to the cap 300 and with reference to FIGS. 3A and 3B, they will not be described in additional detail here. Although modifications to these features described above may also be incorporated into the adapter 400.

Unlike the cap 300, however, the adapter 400 also includes a fluid passageway 414, illustrated as extending axially through the top 402 and the plug 408. The adapter 400 also includes a nozzle 416 or other protrusion provided as a dispensing features. More specifically, the nozzle 416 extends from the top 402, generally along the longitudinal axis 410, and the fluid passageway 414 extends through the plug 408, the top 402, and the nozzle 416. As also illustrated, the nozzle 416 may also include protrusions 418, on an external surface. The protrusions 418 may be formed as barbs or similar retention mechanisms, which are known in the art, to promote retention of a conduit, such as a polymeric tube, or the like, on the nozzle 416. In other embodiments, more or fewer protrusions may be provide, or the protrusions 418 may be omitted.

As noted above, the adapter 400 is applied to a container, such as the container 200, in the same manner as the cap 300. However, instead of sealing the container, the adapter 400 provides a rigid nozzle in communication with the opening of the container. Specifically, when the adapter 400 is retained on a container, the passageway 414 provides fluid access between the reservoir of the container and the tip of the nozzle 416. The nozzle 416 may allow for a more controlled dispensing of contents of the container and/or may allow the container to be used in an existing system. For example, a tube or other conduit connected to the nozzle may allow for transporting of the contents of the container to a remote location or system. Accordingly, the contents may be provided in a relatively cheaper container, with the adapter 400 allowing for use of the cheaper container in an existing system. By way of non-limiting example, the adapter 400 may allow for use of contents in a container such as the container 200 instead of in a container with a pre-fabricated nozzle, or a threaded collar that allows for ready integration.

FIG. 5 illustrates another embodiment of the disclosure. More specifically, FIG. 5 illustrates an adapter 500 that includes features similar to the cap 300 and the adapter 400 to promote application of the adapter 500 to a container, but which also includes a luer-type adapter.

As illustrated, the adapter 500 generally includes a top 502 and a sidewall 504 depending from the top 502. Threads 506 are formed on an internal surface of the sidewall 504, and a plug 508 extends generally along an elongate axis 510 from the top 502. An outer surface of the plug 508 and the threads 506 generally define a receptacle 512 for receiving a (unthreaded) neck of a container. Inasmuch as these features and their respective functionalities were described in detail above with regard to the cap 300 and with reference to FIGS. 3A and 3B, they will not be described in additional detail here. Although modifications to these features described above may also be incorporated into the adapter 500.

Unlike the cap 300, however, the adapter 500 also includes a fluid passageway 514, illustrated as extending axially through the plug 508. The adapter 400 also includes a luer-style fitting 516 extending upwardly from the top 502. The fitting 516 is a female-type luer fitting, having a tapered opening 518 in fluid communication with the passageway 514 and a luer thread 520 depending from an external surface of the fitting 516. As with the adapter 400, the adapter 500 may allow for integration of certain types of containers, i.e., those that do not include a threaded neck and/or that have irregularities or variances, into existing systems that have conventionally required certain types of containers.

FIGS. 4 and 5 illustrated only two embodiments of adapters. A person having ordinary skill in the art, with the benefit of this disclosure, will appreciate that features of this disclosure may be incorporated into other adapters that allow for use with other types of systems and components. By way of non-limiting example, instead of the nozzle 416 or the female-style luer fitting 516, an adapter may include a male-style luer fitting, a nipple, a threaded connecter, or the like.

Other modifications to the caps and adapters described above also are contemplated. For example, as noted above, FIG. 6 illustrates an alternative cap 600 similar to the cap 300, but in which the threads are formed on the plug, instead of the sidewall. More specifically, and as FIG. 6 illustrates, the cap 600 includes a top 602 and a sidewall 604 generally depending from the top 602. Unlike in previous embodiments, an interior surface 606 of the sidewall 604 does not include threads. Instead, the interior surface 606 may be relatively smooth. The cap 600 also includes a plug 608 extending generally along the longitudinal axis, not unlike the plugs discussed above in previous embodiments. Threads 610 are formed on an exterior surface of the plug 608.

In the illustrated embodiment, the interior surface 606 of the sidewall 604 and the threads 610 are spaced from each other, and define a receptacle 612. The receptacle 612 is sized to receive a neck of a container, such as the container 200 discussed above. As with previous embodiments, the receptacle is generally V-shaped, i.e., because the threads 610 and the inner surface 606 of the sidewall 604 are angled relative to each other. Although both the outer surface 606 are illustrated as angled relative to the longitudinal axis of the cap 600, only one need be so angled.

The cap 600 is applied to a container in the same manner as the cap 300 detailed above. Specifically, the plug enters an opening defined by a neck of the container, and the inner surface 606 of the sidewall 604 contacts an outer surface of the neck. The cap 600 may be threaded onto the neck, even in the absence of mating threads on the neck. As will be appreciated by those having ordinary skill in the art, many of the modification discussed above may also be applied to the cap 600. By way of non-limiting example, the cap 600 may include fluid passageway and a nozzle, fitting or the like.

According to the foregoing, examples of novel caps and adapters are described herein. The caps and adapters may be configured for placement on a container in spite of the container having irregularities, variances, and the like. More specifically, embodiments of this disclosure include caps and adapters that may be readily threaded onto non-threaded containers. Such containers may be cheaper and more readily manufactured, but may not be conventionally intended for re-sealing and/or use with existing systems and fixtures.

Although embodiments have been described in language specific to structural features and/or methodological acts, it is to be understood that the invention is not necessarily limited to the specific features or acts of the embodiments described. Rather, the specific features and acts are disclosed as illustrative forms of implementing the invention. For example, while embodiments are described having certain shapes, sizes, and configurations, these shapes, sizes, and configurations are merely illustrative. Also, while some example manufacturing processes are described, applicators according to this disclosure may be made using any other suitable manufacturing process.

What is claimed is:

1. An apparatus comprising:

a container comprising a closed end, a neck circumscribing an opening, and a sidewall extending between the closed end and the neck, the neck being free from threads; and a cap removably couplable to the container to seal the container, the cap comprising:

a top;

at least one sidewall depending from a perimeter of the top in a longitudinal direction, the at least one sidewall having an inner surface angled relative to a longitudinal axis of the cap and including a thread formed thereon, the inner surface being angled such that a first portion of the inner surface proximate the top is relatively closer to the longitudinal axis of the cap than a second portion of the inner surface spaced from the top; and a plug depending from the top in the longitudinal direction generally along a longitudinal axis, the plug being tapered from a first, proximal end proximate the top to a second, distal end spaced from the top, the plug having an outer surface spaced from the inner surface of the at least one sidewall thereby defining a gap between the outer surface of the plug and the inner surface of the sidewall, wherein when the cap is coupled to the container, the neck of the container is disposed in the gap between the outer surface of the plug and the inner surface of the sidewall such that the opening in the container is sealed by the plug and the cap is secured to the neck of the container by the thread on the inner surface of the at least one side wall.

2. The apparatus of claim 1, wherein the container further includes a removable covering.

3. The apparatus of claim 2, wherein the removable covering is attached to the container proximate the opening via a frangible connection.

4. The apparatus of claim 1, wherein removable covering comprises a membrane and the plug includes a pointed member disposed to pierce the membrane.

5. The apparatus of claim 1, wherein the cap further includes a dispensing feature disposed on the top and a fluid passageway extending through the dispensing feature, the top, and the plug.

6. A cap for a container, the cap comprising:

a top;

at least one sidewall depending from the top in a longitudinal direction, an inner surface of the at least one sidewall defining an open space disposed about a longitudinal axis, the inner surface being angled relative to the longitudinal axis such that a first portion of the inner surface proximate the top is relatively closer to the longitudinal axis of the cap than a second portion of the inner surface spaced from the top;

a plug depending from the top in the longitudinal direction generally along the longitudinal axis, the plug having an outer surface spaced from the inner surface of the at least one sidewall; and a thread formed on the inner surface.

7. The cap of claim 6, wherein the outer surface of the plug is angled relative to the inner surface of the sidewall.

8. The cap of claim 6, wherein the outer surface of the plug is angled relative to the longitudinal axis.

9. The cap of claim 7, wherein a distance between the inner surface of the sidewall and the outer surface of the plug, normal to the longitudinal axis, is smaller proximate the top than at a position spaced from the top in the longitudinal direction.

10. The cap of claim 6, wherein the inner surface and the outer surface at least in part define a receptacle of the cap, the receptacle being configured to receive a neck of a container.

11. The cap of claim 6, wherein the sidewall and the plug depend from the top substantially the same distance in the longitudinal direction.

12. The cap of claim 6, further comprising a plurality of grooves on an outer surface of the at least one sidewall.

13. The cap of claim 6, further comprising a-passageway extending through the top and the plug, generally along the longitudinal axis.

14. The cap of claim 13, further comprising a dispensing feature disposed on the top, the passageway further extending through the dispensing feature.

15. The cap of claim 14, wherein the dispensing feature comprises a nozzle, a nipple, a threaded connector or a luer-type fitting.

16. An apparatus comprising:

a container having a neck circumscribing an opening, the neck being free of threads; and a cap comprising:

a top;

at least one sidewall depending from the top in a first longitudinal direction, an inner surface of the at least one sidewall defining an open space disposed about a longitudinal axis, the inner surface being angled relative to the longitudinal axis such that a first portion of the inner surface proximate the top is relatively closer to the longitudinal axis of the cap than a second portion of the inner surface spaced from the top;

a plug depending from the top in the first longitudinal direction generally along the longitudinal axis, the plug having an outer surface spaced from the inner surface;

a thread formed on the inner surface;

a dispensing feature disposed on the top; and a fluid passageway extending through the dispensing feature, the top, and the plug, wherein, when the cap is coupled to the container, at least a portion of the neck of the container is disposed in the gap between the outer surface of the plug and the inner surface of the sidewall such that the opening in the container is sealed by the plug and the cap is secured to the neck of the container by the thread.

17. The apparatus of claim 16, wherein the outer surface of the plug is angled relative to the inner surface of the sidewall.

18. The apparatus of claim 17, wherein a distance between the inner surface of the sidewall and the outer surface of the plug, normal to the longitudinal axis, is smaller proximate the top than at a position spaced from the top in the longitudinal direction.

19. The apparatus of claim 16, wherein the outer surface of the plug is angled relative to a longitudinal axis of the cap.

20. The apparatus of claim 16, wherein the dispensing feature comprises a nozzle, a nipple, a threaded connector or a luer-type fitting.

* * * * *